US007191706B2

(12) United States Patent
Chase et al.

(10) Patent No.: US 7,191,706 B2
(45) Date of Patent: Mar. 20, 2007

(54) OPTICALLY TRIGGERED FIRE SET/DETONATOR SYSTEM

(75) Inventors: Jay B. Chase, Alameda, CA (US); Philip A. Pincosy, Oakland, CA (US); Donna M. Chato, Tracy, CA (US); Hugh Kirbie, Los Alamos, CA (US); Glen F. James, Livermore, CA (US)

(73) Assignee: The Regents of the University of California, Oakland, CA (US)

( * ) Notice: Subject to any disclaimer, the term of this patent is extended or adjusted under 35 U.S.C. 154(b) by 138 days.

(21) Appl. No.: 10/676,704

(22) Filed: Sep. 30, 2003

(65) Prior Publication Data

US 2005/0183607 A1 Aug. 25, 2005

(51) Int. Cl.
*F42D 1/02* (2006.01)
*F42D 1/045* (2006.01)

(52) U.S. Cl. ..... 102/217; 102/202.7; 102/218; 102/206; 361/248

(58) Field of Classification Search ..... 102/217, 102/202.7, 213, 206, 200, 201, 218; 361/251, 361/248, 249
See application file for complete search history.

(56) References Cited

U.S. PATENT DOCUMENTS 3,978,791 A 9/1976 Lemley et al.
4,762,067 A 8/1988 Barker et al.
4,788,913 A 12/1988 Stroud et al.
4,869,170 A * 9/1989 Dahmberg et al. ..... 102/202.5
4,928,595 A * 5/1990 Weingart ..... 102/202.7
5,080,016 A * 1/1992 Osher ..... 102/202.7
5,206,455 A 4/1993 Williams et al.
5,347,929 A 9/1994 Lerche et al.
5,479,860 A 1/1996 Ellis
5,503,077 A * 4/1996 Motley ..... 102/202.5
5,682,008 A * 10/1997 Chervinsky et al. ..... 102/202.7
5,731,538 A 3/1998 O'Brien et al.
5,756,924 A * 5/1998 Early ..... 102/201
5,789,697 A * 8/1998 Engelke et al. ..... 102/202.5
6,227,114 B1 * 5/2001 Wu et al. ..... 102/201
6,385,031 B1 * 5/2002 Lerche et al. ..... 361/248
6,386,108 B1 * 5/2002 Brooks et al. ..... 102/217
6,389,975 B1 * 5/2002 Haddon et al. ..... 102/219
6,470,803 B1 * 10/2002 Liu et al. ..... 102/206
6,732,656 B1 * 5/2004 Heyse et al. ..... 102/202.1
6,752,083 B1 * 6/2004 Lerche et al. ..... 102/202.7
2003/0159609 A1 * 8/2003 Rauscher, Jr. ..... 102/217

* cited by examiner

*Primary Examiner*—James S. Bergin
(74) *Attorney, Agent, or Firm*—Michael C. Staggs; John H. Lee

(57) ABSTRACT

The present invention is directed to a system having a plurality of capacitor discharge units (CDUs) that includes electrical bridge type detonators operatively coupled to respective explosives. A pulse charging circuit is adapted to provide a voltage for each respective capacitor in each CDU. Such capacitors are discharged through the electrical bridge type detonators upon receiving an optical signal to detonate respective operatively coupled explosives at substantially the same time.

16 Claims, 2 Drawing Sheets

OPTICALLY TRIGGERED FIRE SET/DETONATOR SYSTEM

The United States Government has rights in this invention pursuant to Contract No. W-7405-ENG-48 between the United States Department of Energy and the University of California for the operation of Lawrence Livermore National Laboratory.

BACKGROUND OF THE INVENTION

1. Field of the Invention

The present invention relates to explosives. More particularly, the invention relates to a method and apparatus for simultaneously initiating multiple explosive devices for use in various applications, including wellbore applications.

2. Description of Related Art

The process of selectively placing holes in a liner and cement so that oil and gas can flow from a reservoir formation into the wellbore and eventually to the surface is generally known as "perforating." One such perforation technique includes triggering a detonation system to launch a projectile, such as a shaped charge jet, to perforate and fracture the formation so as to create the flow path.

Typically, a large number of shaped charges are inserted into the wellbore in what is called a gun. The charges are contained in a steel tube, protected from impact and from the well fluids, and are arranged so that they face radially outward from the vertical axis of the carrier. The shaped charge is capable of being initiated by, for example, a detonating chord, which when initiated by a percussion detonator or by an electrical detonator causes the shaped charges to fire and create the hydrocarbon flow path into the wellbore.

The firing of the individual charges can produce interfering shock effects that reduce performance of adjacent shaped charges if initiated simultaneously. Therefore, some separation between charges is required to reduce likelihood that the detonation of an individual charge interferes with the subsequent detonation of an adjacent charge. Typically, the separation distance required for proper firing of charges varies with the particular gun design and depends upon the application. A separation between shaped charges reduces the number of perforations into the formation for a given length gun, which decreases the productivity of the well and therefore increases costs.

Another type of electrically activated detonator, capable of activating explosive devices, such as shaped charges, is the exploding foil initiator (EFI). Conventionally, such a device includes a metallic foil that is connected to a very powerful source of pulsed electric current. A reduced neck section in the foil explosively vaporizes when subjected to a sufficiently high and sufficiently quick current pulse, and that causes a small, thin disk torn from a contiguous insulating material layer to fly a short distance and impact the surface of an explosive, initiating a detonation. Other electrically activated initiators include exploding bridge wire (EBW) initiators, exploding foil "bubble activated" initiators, hot wire blasting caps, etc.

Jitter is the shot-to-shot variation of the time between the electrical pulse and the initiation of a detonation in the main high explosive charge. The lowest value of jitter is determined by the detonator itself, but larger jitter values are always experienced due to the characteristics of the other components in the electrical firing system. Low energy detonators, such as blasting caps, have very slow electrochemical trains (sequence of electrical and chemical stages) that produce large amounts of shot-to-shot jitter. High-energy detonators, such as EFIs (slappers), utilize large, quick pulses of electricity to minimize the electrochemical train burn times. To fire more than one detonator such that an entire array of detonators function together requires a robust and elaborate electrical distribution system to bring the powerful pulse of electricity to each detonator in the array from a central fast discharge fire set.

Less robust and elaborate conventional electric distribution systems are not satisfactory for simultaneous multiple detonations. The individual firing times of these types of systems can vary by microseconds. A typical detonation wavefront within a secondary explosive travels at a velocity in excess of 6 millimeters/microsecond (RDX is approximately 8 millimeters/microsecond and HNS is more than 6 millimeters/microsecond). Since these secondary explosives are typically used as part of a detonator's electrical-chemical train leading to the initiation of the main explosive charge, even minor fabrication variances will produce significant variances in the firing times of the individual detonators, destroying the proper operation of adjacent shaped charges due to overlapping pressure waves from the mistimed individual detonators. Therefore, by integrating a compact fast fire set within each detonator, such a distribution system can be eliminated.

Slapper detonator systems (e.g., a chip slapper) can include an energy storage capacitor, a breakdown switch, an exploding foil initiator and a flier. Background information on a fire set/slapper detonator method and system is disclosed in U.S. Pat. No. 5,731,538, titled "METHOD AND SYSTEM FOR MAKING INTEGRATED SOLID-STATE FIRE-SETS AND DETONATORS," issued Mar. 24, 1998, to O'Brien et al., including the following: "A slapper detonator comprises a solid-state high-voltage capacitor, a low jitter dielectric breakdown switch and trigger circuitry, a detonator transmission line, an exploding foil bridge, and a flier material. All these components are fabricated in a single solid-state device using thin film deposition techniques." In addition, U.S. Pat. No. 4,788,913, issued to Stroud et al., U.S. Pat. No. 3,978,791, issued to Lemly et al., U.S. Pat. No. 4,471,697, issued to McCormick et al., and U.S. Pat. No. 6,470,802 B1, issued to Neyer et al., disclose "slapper", foil initiator detonators or multilayer chip slappers.

Background information on an electrical firing system that includes an exploding foil initiator is disclosed in U.S. Pat. No. 6,386,108, titled "INITIATION OF EXPLOSIVE DEVICES," issued May 14, 2002, to Brooks et al., including the following: "A perforating gun or other downhole tool includes one or more explosive devices that are activatable by corresponding one or more initiator devices, such as capacitor discharge units (CDUs). Each CDU includes an explosive foil initiator (EFI) or some other type of a high-energy bridge-type initiator, an energy source (e.g., a slapper capacitor), and a switch coupling the energy source and the EFI or other bridge-type initiator. An electrical cable is coupled to the CDUs for providing a voltage to energize the energy source in the CDUs to provide energy to each EFI. In response to activation of a trigger signal down the electrical cable, the switch is closed to couple the energy source to the EFI."

Further background information on an electrical firing system that includes an exploding foil initiator is disclosed in U.S. Pat. No. 5,347,929, titled "FIRING SYSTEM FOR A PERFORATING GUN INCLUDING AN EXPLODING FOIL INITIATOR AND AN OUTER HOUSING FOR CONDUCTING WIRELINE CURRENT AND EFI CURRENT," issued Sep. 20, 1994, to Lerche et al., including the following: "A fire set circuit provides a discharge pulse to the firing head, and a wireline conductor cable provides a wireline current to the fire set circuit. The firing head includes an outer pressure bulkhead housing adapted for conducting the wireline current from the wireline conductor cable to the fireset circuit, and an exploding foil initiator (EFI) responsive to the discharge pulse from the fire set circuit for initiating the detonation of a secondary explosive."

Accordingly, there is a need to provide an explosive apparatus that can even more precisely trigger large arrays of fast detonators. The present invention is directed to such a need.

SUMMARY OF THE INVENTION

The present invention is directed to a system having a plurality of capacitor discharge units (CDUs), wherein each CDU includes an optical receiver, an electrical storage capacitor and an electrical bridge type detonator operatively coupled to a respective explosive. A pulse charging circuit is adapted to provide a voltage for each respective storage capacitor in each CDU. Such capacitors are operatively discharged through the electrical bridge type detonators upon receiving an optical trigger that results in simultaneous initiation of the electrical bridge type detonators and operatively coupled explosives.

Another aspect of the present invention is directed to a system for use in a wellbore having a plurality of capacitor discharge units (CDUs), wherein each CDU includes an optical receiver, an electrical storage capacitor and a chip slapper detonator operatively coupled to a respective shaped charge. A pulse charging circuit is adapted to provide a voltage for each respective capacitor in each CDU and such capacitors are operatively discharged through the chip slappers upon receiving an optical signal from one or more optically coupled transmission fibers that results in simultaneous initiation of the chip slappers and operatively coupled shaped charge.

A final aspect of the present invention is directed to a method for use in a wellbore that includes providing a plurality of capacitor discharge units, wherein each of the units further comprises: a fiber coupled optical receiver, an electrical storage capacitor and an electrical bridge type detonator, wherein each electrical bridge type detonator is operatively coupled to a shaped charge. Thereafter, the method provides a charge voltage for each of the electrical storage capacitors, and optically triggers the fiber coupled optical receivers to discharge the voltage in each electrical storage capacitor and operatively initiate each respective electrical bridge type detonator so as to simultaneously initiate each respective shaped charge.

Accordingly, the present system and method provides a desired system and method capable of optically triggering high explosives at a point in space at a precisely predetermined time with very low jitter to less than about 50 ns between initiation points in the array. Such a system and method can provide a close-packed array of shaped charges that is beneficial to oil servicing industries because of an increased yield in hydrocarbon production.

BRIEF DESCRIPTION OF THE DRAWINGS

The accompanying drawings, which are incorporated into and form a part of the disclosure, illustrate an embodiment of the invention and, together with the description, serve to explain the principles of the invention.

DETAILED DESCRIPTION OF THE INVENTION

Figure 1:
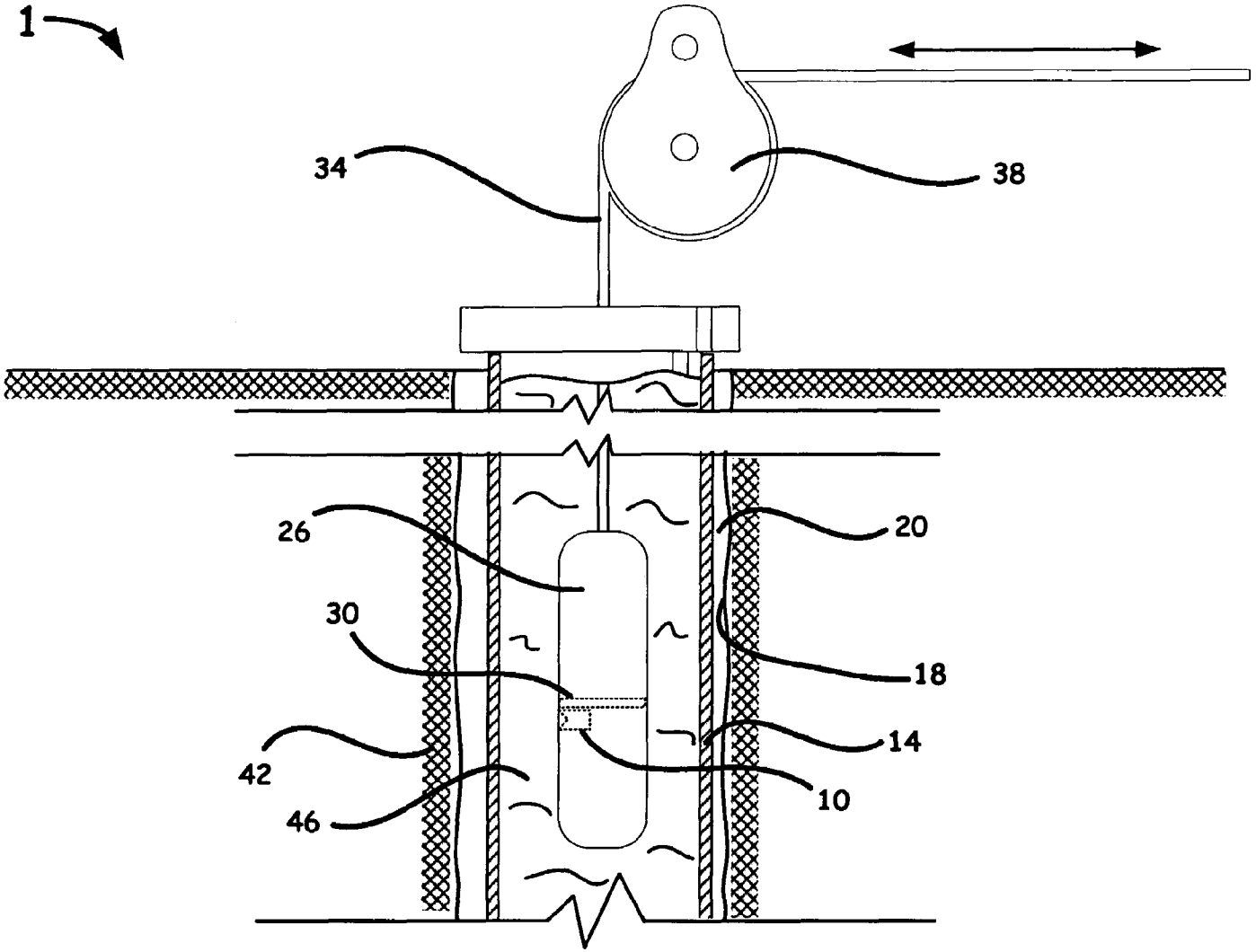
FIG. 1 shows an example of a perforating gun in a wellbore.

Referring now to the drawings, specific embodiments of the invention are shown. The detailed description of the specific embodiments, together with the general description of the invention, serve to explain the principles of the invention.

Unless otherwise indicated, all numbers expressing quantities of ingredients, constituents, reaction conditions and so forth used in the specification and claims are to be understood as being modified in all instances by the term "about". Accordingly, unless indicated to the contrary, the numerical parameters set forth in the specification and attached claims are approximations that may vary depending upon the desired properties sought to be obtained by the subject matter presented herein. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the subject matter presented herein are approximations, the numerical values set forth in the specific examples are reported as precisely as possible. Any numerical value, however, inherently contains certain errors necessarily resulting from the standard deviation found in their respective testing measurements.

General Description

The present invention is capable of utilizing optically triggered, solid-state control devices, such as, but not limited to, an Insulated Gate Bipolar Transistor or a MOS-Controlled Thyristor (MCT) as transmitters and/or optical receivers integrated into an application specific integrated circuit (ASIC), to operate as a high voltage switch. As part of the system and method of the present invention, the optical trigger for the optical receivers can be a pulse from a single source, such as, an LED, a laser or any optical source capable of delivering an optical signal to trigger the control devices of the present invention and thereby initiate (i.e., detonate) the explosives/shaped charges.

The emission from such a source is propagated via one or more fiber optic transmission cables having lengths from about 1 meter to at least about 100 meters to provide optical activation triggering for each capacitor discharge unit (CDU), i.e., to trigger a respective integrated detonator, such as, a slapper detonator or any electrically exploded bridge type initiator source. Since light travels down such a fiber cable at about ½ the vacuum speed of light (about 0.3 m/ns), differences in fiber path length are not critical in specifying the exact time of intended detonation provided that the associated optical transmitters and optical receivers, such as those disclosed herein, are carefully selected to operate in the nanosecond time frames of the present invention of less than 120 ns with less than about 50 ns of jitter. Utilizing such fiber optical transmission lines instead of an electrical wire means reduces the overall costs of the system.

The CDU/detonator of the present invention is also capable of being pulsed charged from a remote source from about 1 meter to at least about 100 meters. A pulse charging time of at least one millisecond (ms) can be achieved through extended twisted pair transmission lines and/or coaxial cables. A 1-ms pulse charging time allows for the transmission inductance to be large, thus permitting long cable lengths between a charging source and a (CDU). Detonator safety is thereby enhanced because the detonator-fire set can remain uncharged and therefore safe until at least about 1 ms before the intended firing time.

To increase reliability, the detonators of the present invention are designed to discharge at the end of the 1-ms charging window, such that the capacitor and switch are minimally stressed electrically due to the short time at which they see a high voltage. Also reliability is achieved by the use of components, such as MCTs, that do not pre-fire when subjected to below trigger optical stimulation as opposed to, for example, GaAS optical devices that can pre-trigger when under electrical stress. In addition, pre-trigger is minimized by the use of a noise (i.e., electrical noise) immune optical system, such as disclosed herein.

It is therefore beneficial that by incorporating technologies such as pulse charging, chip slappers, reliable solid-state switches, and optical triggering, simultaneous firing of less than about 120 ns is capable of being provided by the present invention for potentially large arrays of at least up to about 100 detonators. Such simultaneity enables the charges to be stacked closer (limited only by the dimensions of the shaped charges) and thus increase, for example, hydrocarbon production due to an increase in shot density.

Specific Description

The method and apparatus of the present invention is useful for enhancing the penetration of a shaped charge perforator into a reservoir material. However, the present invention is additionally capable of being employed in various other applications involving the initiation of charges, such as, for example, industrial mining, explosive bolts, ordnance, etc.

FIG. 1 shows a conventional configuration for extracting hydrocarbons from a well-site utilizing a shaped charge 10 and is generally designated by the reference numeral 1. A steel casing 14 is put into a borehole 18 and held in place with cement 20 which fills the void between the outer diameter of borehole 18 and steel casing 14 and bonds to steel casing 14 to prevent borehole 18 from collapsing. Shaped charges 10 (only one shown for clarity) are arranged in perforating gun 26 and operatively connected to a source 30 capable of detonating shaped charges 10. Perforating gun 26 can be lowered into borehole 18 on a wire-line 34 by a mechanical control means 38 and is positioned into borehole 18 adjacent to a formation 42 analyzed as having hydrocarbons. Shaped charges 10 are sealed within perforating gun 26 to prevent well fluids 46 from contaminating shaped charge 10. Electrical peripheral devices (not shown) are connected to source 30 through electrical conductors (not shown) enclosed in wire-line 34 and are capable of providing electrical energy to source 30 for energizing storage capacitors in source 30 and can additionally provide an electrical trigger signal to source 30 so as to detonate shaped charges 10. Resultant holes (not shown) through steel casing 14, cement 20 and formation 42 from the detonation of shaped charges 10, can enable oil and gas to flow from formation 42 into the wellbore (i.e., the interior of steel casing 14) and extracted.

Figure 2:
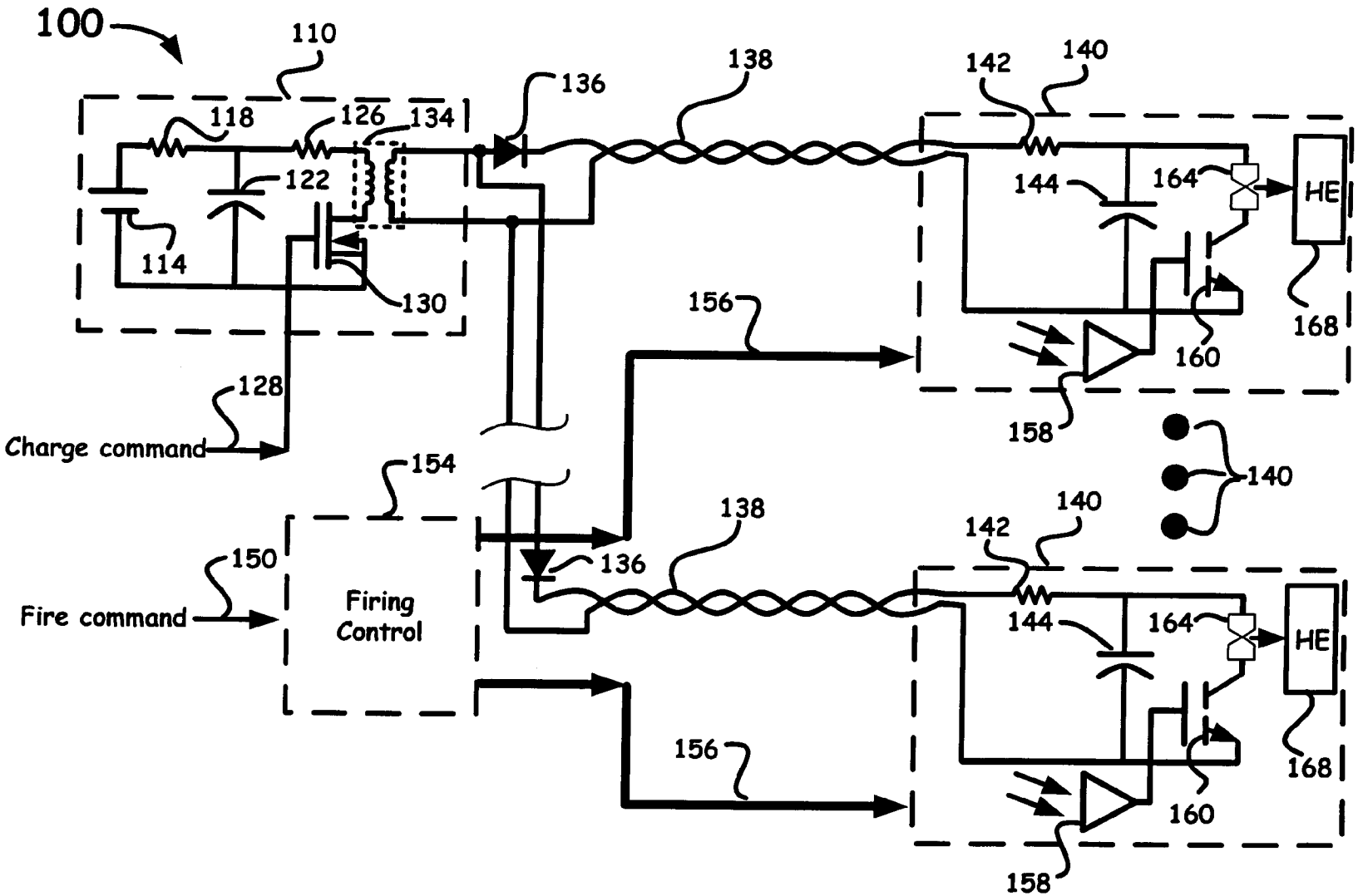
FIG. 2 shows an example circuit diagram of a fire-set detonator of the present invention.

FIG. 2 illustrates the various components of a fire-set/detonator system, generally designated by the reference numeral 100, for perforating and propagating a fracture in a formation by detonation of shaped charges 10, as shown in FIG. 1. Fire-set/detonator system 100 includes a remote pulse charging circuit assembly 110, a plurality of at least up to about 100 CDUs 140 electrically coupled to pulse charging circuit assembly 110 by twisted wire pairs 138 or coaxial cables, and a firing control module 154 capable of optically triggering CDUs 140 so as to detonate respective operatively coupled high explosives (HE), such as shaped charges 168, with near simultaneity of less than about 50 ns of jitter, to assure that pressure waves originating from the detonation of such shaped charges (e.g., 168) will not impact the effectiveness of adjacent shaped charges 168.

The example pulse charging circuit 110, as shown in FIG. 2, can include a voltage supply 114 capable of charging voltages between about 25 and about 1000 volts a conventional resistor 118 and a conventional capacitor 122 known to those in the art to provide the required energy to each CDU 140. Current resistor 126 in combination with a control device capable of operating as a switch 130, such as an Insulated Gate Bipolar Transistor, a MOS-Controlled Thyristor (MCT), or any switch capable of being operated within the design parameters of the present invention, are arranged to discharge electrical energy stored in capacitor 122 to CDUs 140 upon receiving a predetermined voltage charge command 128 to the gate of switch 130 from a control source (not shown). A transformer 134 (denoted by a dashed rectangle) coupled with a circuit element 136, such as rectifying diodes, are capable of providing circuit isolation and voltage rectification respectively and circuit element 136 (e.g., diodes) can be designed to provide isolation between CDU capacitors 144.

Each respective CDU 140, having an electrical bridge detonator 164 as part of the CDU circuitry, can be arranged down a wellbore (not shown) to at least about 100 meters. Electrical bridge type detonator 164, such as, for example, an exploding foil flying plate initiator, an exploding foil bubble activated initiator, an exploding bridge wire initiator, or more often a slapper (e.g., a chip slapper) of the present invention having an aluminum bridge detonator that is capable of being activated with less than about 50 mj of electrical energy, is arranged between about 6 and about 10 mm of standoff to a respective shaped charge explosive 168. Specifically, electrical bridge type detonator 164 is in operable contact with a small mass of low density secondary explosive that includes, but is not limited to, PETN, CL20, HNS, or RDX or other low density explosive known in the art to begin the detonation process. Such a small mass of low density explosive is in contact with a larger mass of high density explosive, such as, but not limited to, PETN, CL20, HNS, or RDX, or other high density explosive known in the art to complete the initiation process.

Each CDU is capable of being triggered by a firing control circuit 154 that can output one or more optical trigger signals from commercially available predetermined optical transmitters via a plurality of optical fibers 156. Pulse charging circuit 110 provides the electrical energy of up to about 1000 volts, wherein a predetermined charging CDU resistor 142 and CDU capacitor 144 (e.g., a 0.1 μf capacitor) having an RC time constant of ¼ ms, is discharged upon a fire command 150. Each arranged commercially available optical receiver 158 in each respective CDU 140 can receive a respective optical trigger signal and can accordingly provide a required predetermined voltage to the gate of a switch 160, such as, but not limited to, an Insulated Gate Bipolar Transistor, a MOS-Controlled Thyristor (MCT) or other solid-state breakdown switches. Switch 160 can then enable the voltage stored in capacitors 144 to pass through, for example, a path (not shown), such as, for example, an aluminum electrical path, in each electrical bridge type detonator 164, such as a chip slapper. Such a path is vaporized in less than about 50 ns and operably sends a shock wave into the low density explosive, initiating detonation. The low density explosive in turn can initiate the larger mass of high density explosive that is arranged in, for example, shaped charge 168 and can enable the metal liner (not shown) of each respective shaped charge 168 to perforate steel casing 14 and formation 42, as shown FIG. 1, so as to allow hydrocarbon flow production.

In an alternate embodiment, pulse charging supply 110 can be arranged down the wellbore (not shown) of up to at least about a mile down the wellbore and positioned adjacent the plurality of CDUs 140. In this embodiment, voltage power supply 114, as shown in FIG. 2, is arranged above ground to provide electrical energy to the remaining circuitry of pulse charging circuit 110. A single optical fiber transmission line can be sent down the wellbore and optically initiate a firing control 154 having optical means, such as optical-fiber splitters or any optical method of relaying an optical trigger signal, to each optical receiver 158 in each CDU 140 upon receiving a fire command 150. Such an arrangement minimizes the number of optical fibers utilized, provides a cost efficient system, and extends the distance such an optically triggered detonator system of the present invention can be arranged down the wellbore. As another example arrangement, a separate fiber transmission line (not shown) can be arranged as a dedicated charge command 128 to pulse charging supply 110 that is designed for such optical signals. Such an arrangement further simplifies system 100 and provides further electrical noise immunity to system 100 as a whole.

Typical chip slapper detonators include a ceramic substrate with a deposited film such as copper etched into shaped wide area conductive lands and a narrow bridge portion extending between such lands. A dielectric coating, such as a polymide, KAPTON™ (i.e., a polyimide film developed which can remain stable in a wide range of temperatures) or PARALENE™ (i.e., a unique series of polymers based on paraxylene), is applied over the bridge portion, wherein a small section (i.e., a flying plate) of this dielectric is accelerated away from the substrate and towards an explosive when an applied voltage (e.g., greater than about 2000 volts) vaporizes the narrow bridge portion. The shock of such a flying plate detonates the explosive. By utilizing modified chip slappers that can initiate with less than 50 mj of electrical energy, the present invention's associated components (such as capacitors, switches, etc.) overall current, voltage, and thus size requirements can be reduced, which leads to lower component costs and allows the design arrangement of such units in a perforating gun to be less stringent.

Accordingly, such reduced requirements enable an example compact embodiment of a CDU, i.e., the optical receiver, switch, electrical storage capacitor and slapper, of the present invention to be provided in a package of down to about 8.0×8.0 by 24 mm in dimension.

It should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a plurality of capacitor discharge units, wherein each of said units further comprises: an optical receiver, an electrical storage capacitor, and an electrical bridge detonator, wherein each said electrical bridge detonator can be initiated with less than about 50 mj of energy at the end of about a 1 millisecond charging time window and wherein each said electrical bridge detonator is operatively coupled to an explosive, a pulse charging circuit operatively coupled to said plurality of capacitor discharge units and adapted to provide a charging voltage for each respective said electrical storage capacitor; and one or more optical fibers adapted to provide an operatively coupled optical trigger signal to each said optical receiver and operatively discharge said voltage in each said electrical storage capacitor to thereby simultaneously initiate each said electrical bridge detonator and each operatively coupled said explosive.

2. The system of claim 1, wherein each said explosive is initiated in less than about 120 ns.

3. The system of claim 1, wherein said electrical bridge detonator includes an aluminum bridge.

4. The system of claim 1, wherein said one or more optical receivers triggers a switch to discharge said electrical storage capacitors.

5. The system of claim 4, wherein said switch comprises at least one from: a Power Fet, a solid dielectric breakdown switch, a MOS-Controlled Thyristor and an Insulated Gate Bipolar Transistor.

6. The system of claim 1, wherein a charge command to said pulse charging circuit is an optical charge command.

7. A system for use in a wellbore, comprising:

a plurality of capacitor discharge units, wherein each of said units further comprises: an optical receiver, an electrical storage capacitor, and a chip slapper, wherein each said chip slapper is operatively coupled to a shaped charge and wherein said chip slapper is capable of being initiated with less than about 50 mj of energy at the end of about a 1 millisecond charging window, a pulse charging circuit operatively coupled to said plurality of capacitor discharge units and adapted to provide a charging voltage for said electrical storage capacitors; and a plurality of optical fibers capable of providing an optical trigger signal to each said optical receiver, wherein each said optical receiver upon receiving said optical trigger signal can operatively discharge said voltage in each said electrical storage capacitor and simultaneously initiate each said chip slapper and each operatively coupled said shaped charge.

8. The system of claim 7, wherein each said shaped charge is initiated in less than about 120 ns.

9. The system of claim 7, wherein said chip slapper includes an aluminum bridge.

10. The system of claim 7, wherein said optical receivers triggers a switch to discharge said electrical storage capacitors.

11. The system of claim 10, wherein said switch comprises at least one from: a Power Fet, a solid dielectric breakdown switch, a MOS-Controlled Thyristor and an Insulated Gate Bipolar Transistor.

12. A method for use in a wellbore, comprising:

providing a plurality of capacitor discharge units, wherein each of said units further comprises: a fiber coupled optical receiver, an electrical storage capacitor and an electrical bridge detonator, wherein each said electrical bridge detonator is operatively coupled to a shaped charge and wherein each said electrical bridge detonator includes a chip slapper capable of being initiated with less than 50 mj of energy at the end of about a 1 millisecond charging window, providing a charge voltage for each of said electrical storage capacitors; and optically triggering said fiber coupled optical receivers to operatively discharge said voltage in each said electrical storage capacitor and simultaneously initiate each respective said electrical bridge detonator and each operatively coupled said shaped charge.

13. The method of claim 12, wherein each said shaped charge is initiated in less than about 120 ns.

14. The method of claim 12, wherein said chip slapper includes an aluminum bridge.

15. The method of claim 12, wherein said optical receivers triggers a switch to discharge said electrical storage capacitors.

16. The method of claim 15, wherein said switch comprises at least one from: a Power Fet, a solid dielectric breakdown switch, a MOS-Controlled Thyristor and an Insulated Gate Bipolar Transistor.

* * * * *